US012259171B2

(12) United States Patent
Mitchell

(10) Patent No.: US 12,259,171 B2
(45) Date of Patent: Mar. 25, 2025

(54) ICE MAKING ASSEMBLY FOR A REFRIGERATOR APPLIANCE

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 251 days.

(21) Appl. No.: 17/957,663

(22) Filed: Sep. 30, 2022

(65) Prior Publication Data

US 2024/0110739 A1 Apr. 4, 2024

(51) Int. Cl.
*F25C 5/00* (2018.01)
*F25C 5/20* (2018.01)

(52) U.S. Cl.
CPC ..... *F25C 5/22* (2018.01); *F25C 2700/02* (2013.01)

(58) Field of Classification Search
CPC .... F25C 5/187; F25C 5/22; F25C 5/24; F25C 1/04; F25C 2700/02
See application file for complete search history.

(56) References Cited

U.S. PATENT DOCUMENTS

| | | | | |
|---|---|---|---|---|
| 2,957,604 | A | 10/1960 | Goldman et al. | |
| 3,163,018 | A | 12/1964 | Shaw | |
| 3,850,008 | A | 11/1974 | Frazier | |
| 4,261,182 | A | 4/1981 | Elliot | |
| 5,056,321 | A | 10/1991 | Patrick | |
| 6,351,958 | B1 * | 3/2002 | Pastryk | G01F 23/2921 250/227.25 |
| 8,037,697 | B2 | 10/2011 | LeClear et al. | |
| 8,539,779 | B2 | 9/2013 | Kim et al. | |
| 9,097,450 | B2 | 8/2015 | Kim et al. | |
| 9,863,686 | B2 | 1/2018 | Park | |
| 10,788,252 | B2 | 9/2020 | Mitchell et al. | |
| 11,231,217 | B2 | 1/2022 | Mitchell | |
| 2011/0100039 | A1 * | 5/2011 | Kim | F25C 5/187 62/344 |
| 2015/0121942 | A1 * | 5/2015 | Yun | F25C 5/187 62/344 |
| 2019/0078824 | A1 | 3/2019 | Yun | |
| 2019/0338995 | A1 | 11/2019 | Bertolini et al. | |
| 2020/0080759 | A1 | 3/2020 | Shi et al. | |
| 2021/0123652 | A1 * | 4/2021 | Devos | F25C 5/22 |
| 2022/0341644 | A1 * | 10/2022 | Baumer | F25C 5/187 |

FOREIGN PATENT DOCUMENTS

| | | | |
|---|---|---|---|
| CN | 214307731 | U | 9/2021 |
| KR | 100611496 | B1 | 8/2006 |
| KR | 20060107666 | A | 10/2006 |
| WO | WO2014102111 | A1 | 7/2014 |

* cited by examiner

*Primary Examiner* — Marc E Norman
(74) *Attorney, Agent, or Firm* — Dority & Manning, P.A.

(57) ABSTRACT

A refrigerator appliance includes a cabinet with a door rotatably mounted to the cabinet. The refrigerator appliance also includes an ice making chamber defined in one of the cabinet and the door. An ice making assembly and an ice storage bin are positioned within the ice making chamber. The refrigerator appliance further includes an infrared emitter mounted to a movable part of the ice making assembly and an infrared detector mounted to a movable part of the ice making assembly. The refrigerator appliance further includes an infrared emitter and an infrared detector mounted to the ice making assembly.

15 Claims, 13 Drawing Sheets

ICE MAKING ASSEMBLY FOR A REFRIGERATOR APPLIANCE

FIELD OF THE INVENTION

The present subject matter relates generally to refrigerator appliances, and more particularly to ice making assemblies for refrigerator appliances.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

When the ice storage bin is full, it is desirable to pause ice making in the ice making assembly and/or harvesting ice from the ice making assembly, such as to avoid or limit overfilling the ice storage bin. The ice pieces that accumulate within the ice storage bin do not necessarily do so according to a regular pattern. For example, the ice pieces may pile up in an irregular formation, where a maximum ice level or highest ice piece within the ice storage bin may be reached at one location in the ice storage bin while other ice pieces at other points in the ice storage bin are below the maximum ice level. Thus, for example, in a cross-section of the ice storage bin taken in a plane generally perpendicular to the vertical direction at the maximum ice level, the accumulated ice may reach the maximum ice level at some parts of the cross-section, whereas the ice at other parts of the cross-section is below the maximum ice level.

Thus, checking the ice fill level at an area or location where the peak of the ice pile is more likely to be found may be advantageous, and/or checking the ice fill level over an area or portion of the ice storage bin may be advantageous, such as more likely to detect an ice piece or ice pieces at the maximum ice level, such as the first ice piece to reach the maximum ice level, such as the peak or uppermost ice pieces of the accumulated ice in the ice storage bin.

Accordingly, a refrigerator appliance with features for improved ice storage would be desirable. More particularly, a refrigerator appliance including features for detecting a fill level in an ice storage bin that receives and stores ice pieces from an ice making assembly in the refrigerator appliance would be particularly beneficial.

BRIEF DESCRIPTION OF THE INVENTION

Aspects and advantages of the invention will be set forth in part in the following description, or may be apparent from the description, or may be learned through practice of the invention.

According to an exemplary embodiment, a refrigerator appliance is provided. The refrigerator appliance includes a cabinet with a door rotatably mounted to the cabinet. The refrigerator appliance also includes an ice making chamber defined in one of the cabinet and the door. An ice making assembly and an ice storage bin are positioned within the ice making chamber. The refrigerator appliance further includes an infrared emitter mounted to a movable part of the ice making assembly and an infrared detector mounted to a movable part of the ice making assembly.

According to another exemplary embodiment, a refrigerator appliance is provided. The refrigerator appliance includes a cabinet with a door rotatably mounted to the cabinet. The refrigerator appliance also includes an ice making chamber defined in one of the cabinet and the door. An ice making assembly and an ice storage bin are positioned within the ice making chamber. The refrigerator appliance further includes an infrared emitter mounted to a movable part of the ice making assembly and an infrared detector mounted to a movable part of the ice making assembly. The refrigerator appliance further includes an infrared emitter and an infrared detector mounted to the ice making assembly. The infrared emitter and the infrared detector are positioned above a center portion of the ice storage bin when the infrared emitter and the infrared detector are in a home position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
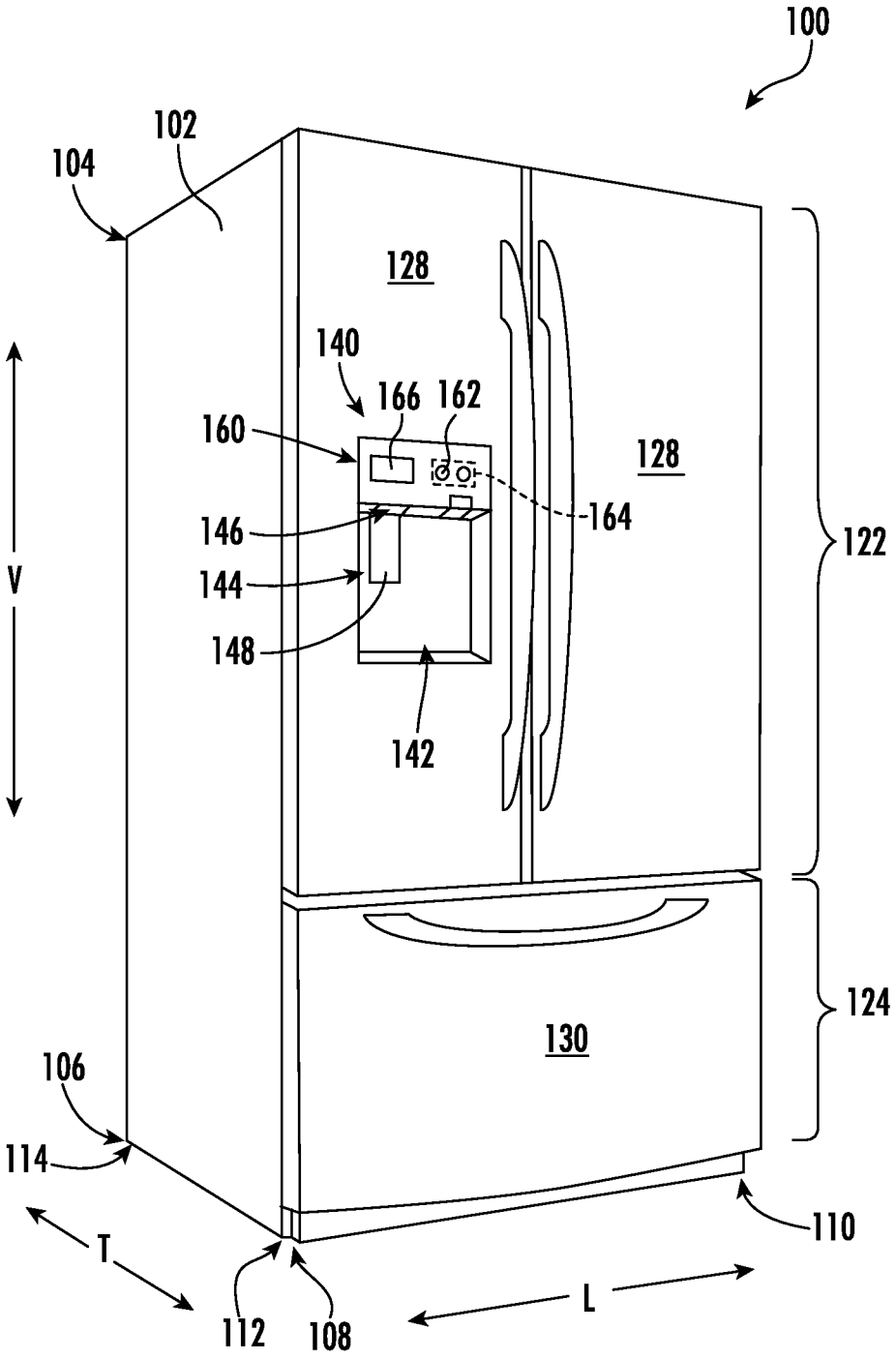
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise. As used herein, the terms "first," "second," and "third" may be used interchangeably to distinguish one component from another and are not intended to signify location or importance of the individual components.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
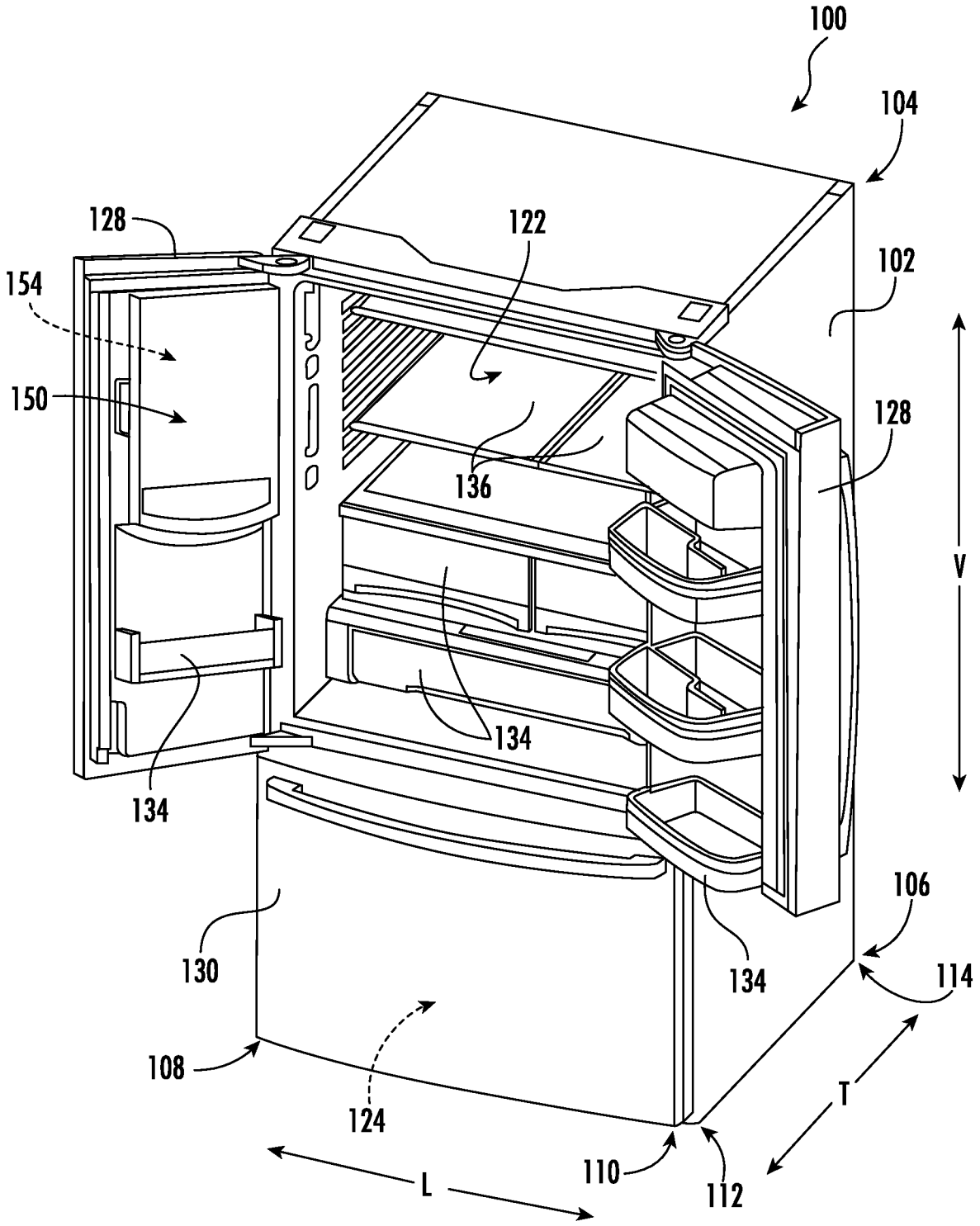
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items, etc.) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

Figure 3:
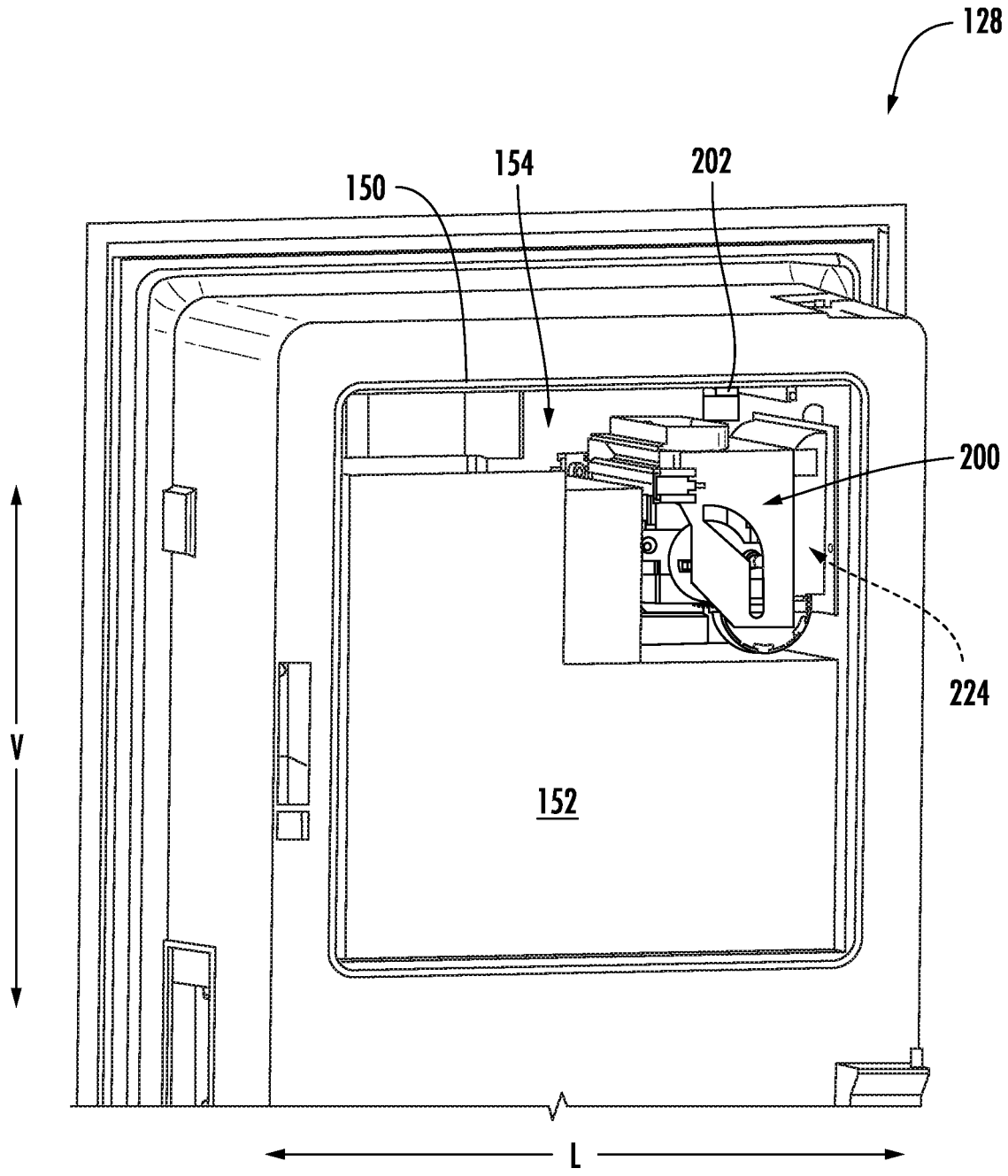
FIG. 3 provides a perspective view of an icebox and ice making assembly for use with the exemplary refrigerator appliance of FIG. 1 according to an exemplary embodiment of the present subject matter.
Figure 4:
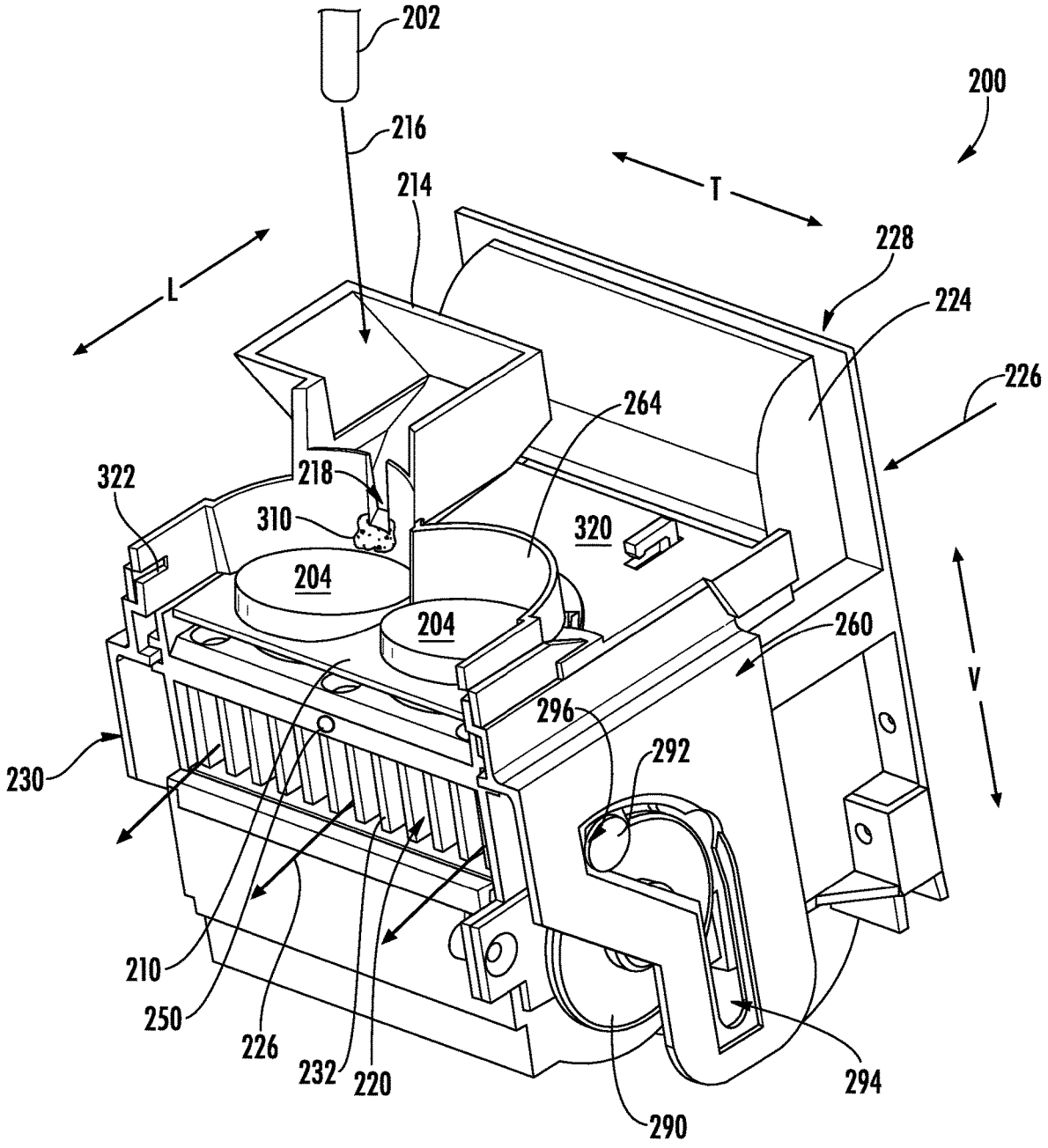
FIG. 4 provides a perspective view of the exemplary ice making assembly of FIG. 3 according to an exemplary embodiment of the present subject matter.

By contrast, inside refrigerator appliance 100, refrigerator door 128 may define an icebox 150 (FIGS. 2 and 3) housing an icemaker and an ice storage bin 152 that are configured to supply ice to dispenser recess 142. In this regard, for example, icebox 150 may define an ice making chamber 154 for housing an ice making assembly, a storage mechanism, and a dispensing mechanism.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring now generally to FIGS. 3 through 13, an ice making assembly 200 that may be used with refrigerator appliance 100 will be described according to exemplary embodiments of the present subject matter. The ice making assembly 200 may be positioned in any chilled chamber, e.g., fresh food chamber 122 or freezer chamber 124, of the refrigerator appliance 100. As illustrated, ice making assembly 200 is mounted in icebox 150 within ice making chamber 154 and is configured for receiving a flow of water from a water supply spout 202 (see, e.g., FIG. 3). More specifically, as described in more detail below, water supply spout 202 may discharge a flow of water into a fill cup that disperses or directs the water into one or more mold cavities.

Where the exemplary illustrated ice making assembly 200 is mounted within the icebox 150 and the icebox 150 is defined by or in one of the refrigerator doors 128, the ice making assembly 200 may thusly be positioned within the fresh food chamber 122, e.g., when the respective door 128 is in the closed position. In additional embodiments, the ice making assembly 200 and ice storage bin 152 may be positioned, for example, in the freezer chamber 124. Accordingly, in various embodiments, the ice making chamber 154 may be located within one of the chilled chambers or may be coextensive with one of the chilled chambers. For example, in some embodiments, the icebox 150 may be defined in or by the freezer door 130, whereby the ice making chamber 154 may be positioned within the freezer chamber 124, e.g., when the freezer door 130 is in the closed position, or the ice box 150 may be defined in a stationary location within the freezer chamber 124, whereby the ice making chamber 154 may be positioned within the freezer chamber 124 independent of the position of the freezer door 130. As another example, in additional embodiments the icebox 150 may be omitted and the ice making assembly 200 and the ice storage bin 152 may be located within the freezer chamber 124, e.g., the ice making chamber 154 and the freezer chamber 124 may be commensurate and coextensive in such embodiments. Thus, the ice making chamber 154 may be defined in one of the cabinet 102 and the doors 128, 130, such as the ice making chamber 154 may be defined in one of the doors 128 or 130 when the icebox 150 is provided in the one of the doors 128 or 130, or the ice making chamber 154 may be defined in the cabinet when the ice box 150 is mounted in one of the chilled chamber 122 and 124 or when the ice box 150 is omitted.

In this manner, ice making assembly 200 is generally configured for freezing the water to form ice cubes 204 (see, e.g., FIGS. 5 and 6, also note that the term "ice cubes" is used broadly herein to include ice pieces of various shapes such as but not limited to rectangular prisms, gem-shaped ice pieces, ice nuggets, or any other desired shape for the ice "cubes") which may be stored in storage bin 152 and dispensed through discharging outlet 146 by dispensing assembly 140. However, it should be appreciated that ice making assembly 200 is described herein only for the purpose of explaining aspects of the present subject matter. Variations and modifications may be made to ice making assembly 200 while remaining within the scope of the present subject matter. For example, ice making assembly 200 could instead be positioned within freezer chamber 124 of refrigerator appliance 100 and may have any other suitable configurations.

According to the illustrated embodiment, ice making assembly 200 includes a resilient mold 210 that defines a mold cavity 212. In general, as described in more detail below, resilient mold 210 is positioned for receiving the gravity-assisted flow of water from water supply spout 202 and containing that water until ice cubes 204 are formed. Resilient mold 210 may be constructed from any suitably resilient material that may be deformed to release ice cubes 204 after formation. For example, according to the illustrated embodiment, resilient mold 210 is formed from silicone or another suitable hydrophobic, food-grade, and resilient material.

In some exemplary embodiments, resilient mold 210 defines two mold cavities 212, each being shaped and oriented for forming a separate ice cube 204. In this regard, for example, water supply spout 202 is configured for refilling resilient mold 210 to a level above a divider wall (not shown) within resilient mold 210 such that the water overflows into each of the mold cavities 212 evenly, e.g., evenly into both mold cavities in the example embodiment illustrated in FIG. 4, or into all mold cavities, e.g., all five mold cavities, in the example embodiments illustrated in FIGS. 8 through 13, or other suitable number of mold cavities as may be provided in various embodiments, such as multiple rows of mold cavities, etc. According to still other embodiments, water supply spout 202 could have a dedicated discharge nozzle positioned over each mold cavity 212. Furthermore, it should be appreciated that according to alternative embodiments, ice making assembly 200 may be scaled to form any suitable number of ice cubes 204, e.g., by increasing the number of mold cavities 212 defined by resilient mold 210.

As shown, ice making assembly further includes a fill cup 214 that is positioned above resilient mold 210 for selectively filling mold cavity 212 with water. More specifically, fill cup 214 may be positioned below water supply spout 202 for receiving a flow of water 216. The fill cup 214 may define a small reservoir for collecting and/or directing the flow of water 216 into mold cavity 212 without excessive splashing or spilling. In addition, fill cup 214 may define a discharge spout 218 that funnels water toward the bottom of the fill cup 214 where it may be dispensed into mold cavity 212.

In general, fill cup 214 and discharge spout 218 may have any suitable size, shape, and configuration suitable for dispensing the flow of water 216 into resilient mold 210. For example, according to the illustrated embodiment, fill cup 214 is positioned over one of the two mold cavities 212 and generally defines sloped surfaces for directing the flow of water 216 to discharge spout 218 immediately above a fill level (not labeled) of the resilient mold 210. According to alternative embodiments, fill cup 214 may extend across a width of the entire resilient mold 210 and may have multiple discharge spouts 218. Fill cup 214 may have still other configurations while remaining within the scope of the present subject matter.

Ice making assembly 200 may further include a heat exchanger 220 which is in thermal communication with resilient mold 210 for freezing the water within mold cavities 212 to form one or more ice cubes 204. In general, heat exchanger 220 may be formed from any suitable thermally conductive material and may be positioned in direct contact with resilient mold 210. Specifically, according to the illustrated embodiment, heat exchanger 220 is formed from aluminum and is positioned directly below resilient mold 210. Furthermore, heat exchanger 220 may define a cube recess 222 which is configured to receive resilient mold 210 and shape or define the bottom of ice cubes 204. In this manner, heat exchanger 220 is in direct contact with resilient mold 210 over a large portion of the surface area of ice cubes 204, e.g., to facilitate an increased rate of heat transfer and quick freezing of the water stored within mold cavities 212. For example, heat exchanger 220 may contact resilient mold 210 over greater than approximately half of the surface area of ice cubes 204. It should be appreciated that as used herein, terms of approximation, such as "approximately," "substantially," or "about," refer to being within a ten percent margin of error.

Figure 5:
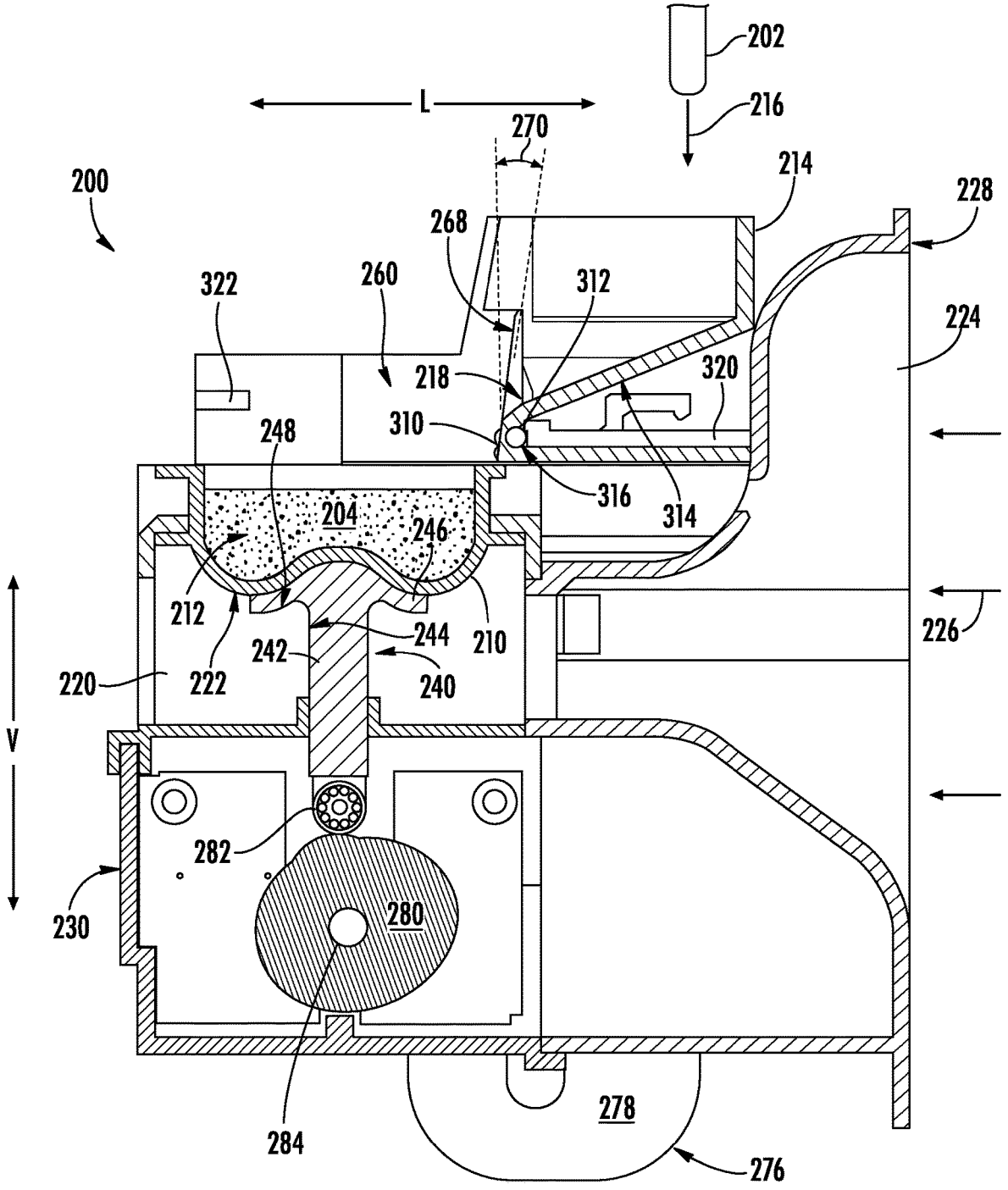
FIG. 5 provides a partial side view of a drive mechanism, a lifter assembly, and a sweep assembly of the exemplary ice making assembly of FIG. 3, with the lifter assembly in a lowered position and the sweep assembly in the retracted position.
Figure 6:
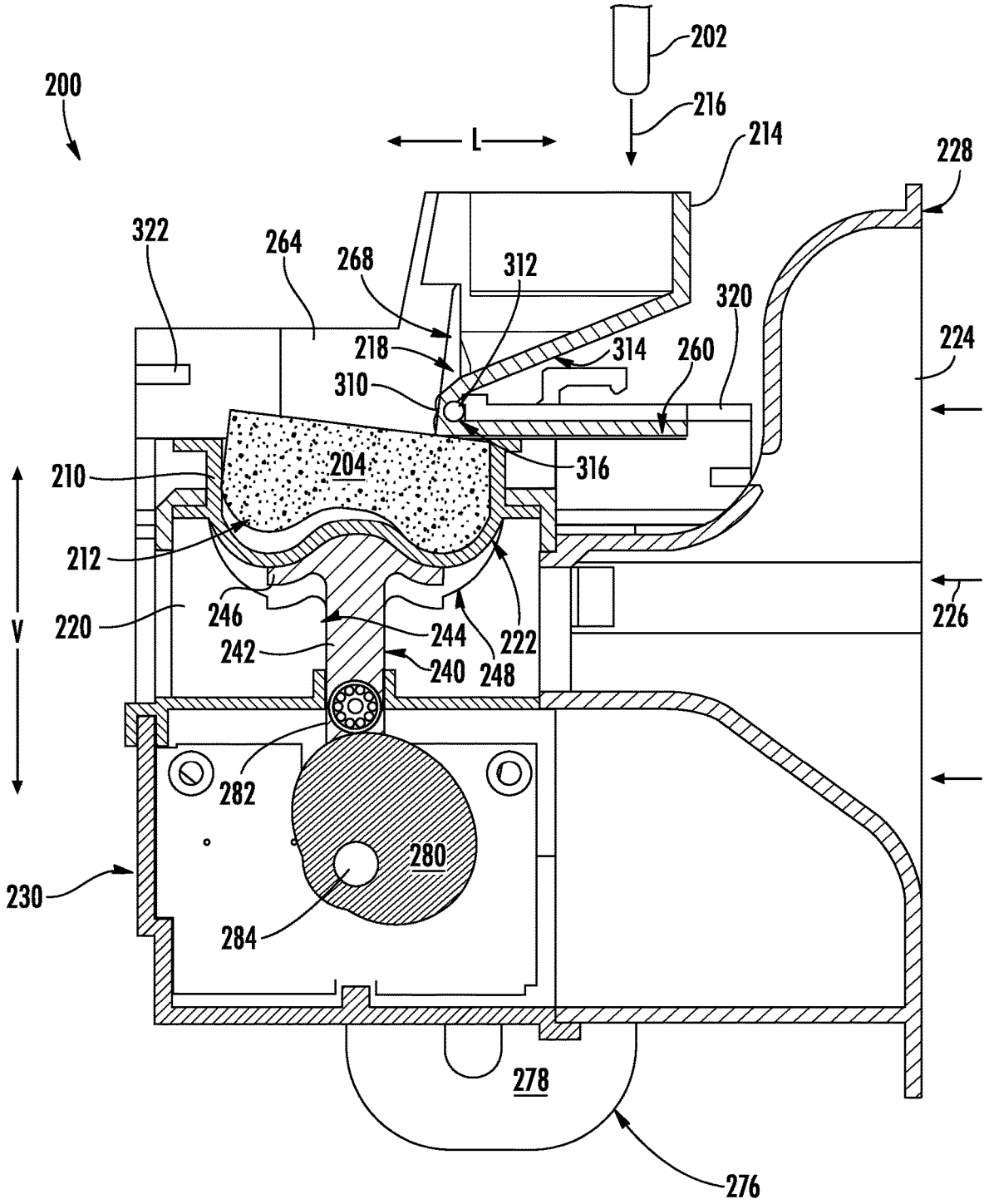
FIG. 6 provides a partial side view of the drive mechanism, the lifter assembly, and the sweep assembly of FIG. 5, with the lifter mechanism in the raised position.

In addition, ice making assembly 200 may comprise an inlet air duct 224 that is positioned adjacent heat exchanger 220 and is fluidly coupled with a cool air supply (e.g., illustrated as a flow of cooling air 226). According to the illustrated embodiment, inlet air duct 224 provides the flow of cooling air 226 from a rear end 228 of ice making assembly 200 (e.g., from the right along the lateral direction L as shown in FIGS. 5 and 6) through heat exchanger 220 toward a front end 230 of ice making assembly 200 (e.g., to the left along the lateral direction L as shown in FIGS. 5 and 6, i.e., the side where ice cubes 204 are discharged into storage bin 152).

As shown, inlet air duct 224 generally receives the flow of cooling air 226 from a sealed system of refrigerator appliance 100 and directs it over and/through heat exchanger 220 to cool heat exchanger 220. More specifically, according to the illustrated embodiment, heat exchanger 220 defines a plurality of heat exchange fins 232 that extend substantially parallel to the flow of cooling air 226. In this regard, heat exchange fins 232 extend down from a top of heat exchanger 220 along a plane defined by the vertical direction V in the lateral direction L (e.g., when ice making assembly 200 is installed in refrigerator appliance 100).

As may be seen, e.g., in FIGS. 5 and 6, ice making assembly 200 further includes a lifter mechanism 240 that is positioned below resilient mold 210 and is generally configured for facilitating the ejection of ice cubes 204 from mold cavities 212. In this regard, lifter mechanism 240 is movable between a lowered position (e.g., as shown in FIG. 5) and a raised position (e.g., as shown in FIG. 6). Specifically, lifter mechanism 240 includes a lifter arm 242 that extends substantially along the vertical direction V and passes through a lifter channel 244 defined within heat exchanger 220. In this manner, lifter channel 244 may guide lifter mechanism 240 as it slides along the vertical direction V.

In addition, lifter mechanism 240 comprises a lifter projection 246 that extends from a top of lifter arm 242 towards a rear end 228 of ice making assembly 200 and towards a front end 230 of ice making assembly 200. As illustrated, lifter projection 246 generally defines the profile of the bottom of ice cubes 204 and is positioned flush within a lifter recess 248 defined by heat exchanger 220 when lifter mechanism 240 is in the lowered position. In this manner, heat exchanger 220 and lifter projection 246 define a smooth bottom surface of ice cubes 204. More specifically, according to the illustrated embodiment, lifter projection 246 generally curves down and away from lifter arm 242 to define a smooth divot on a bottom of ice cubes 204.

Figure 7:
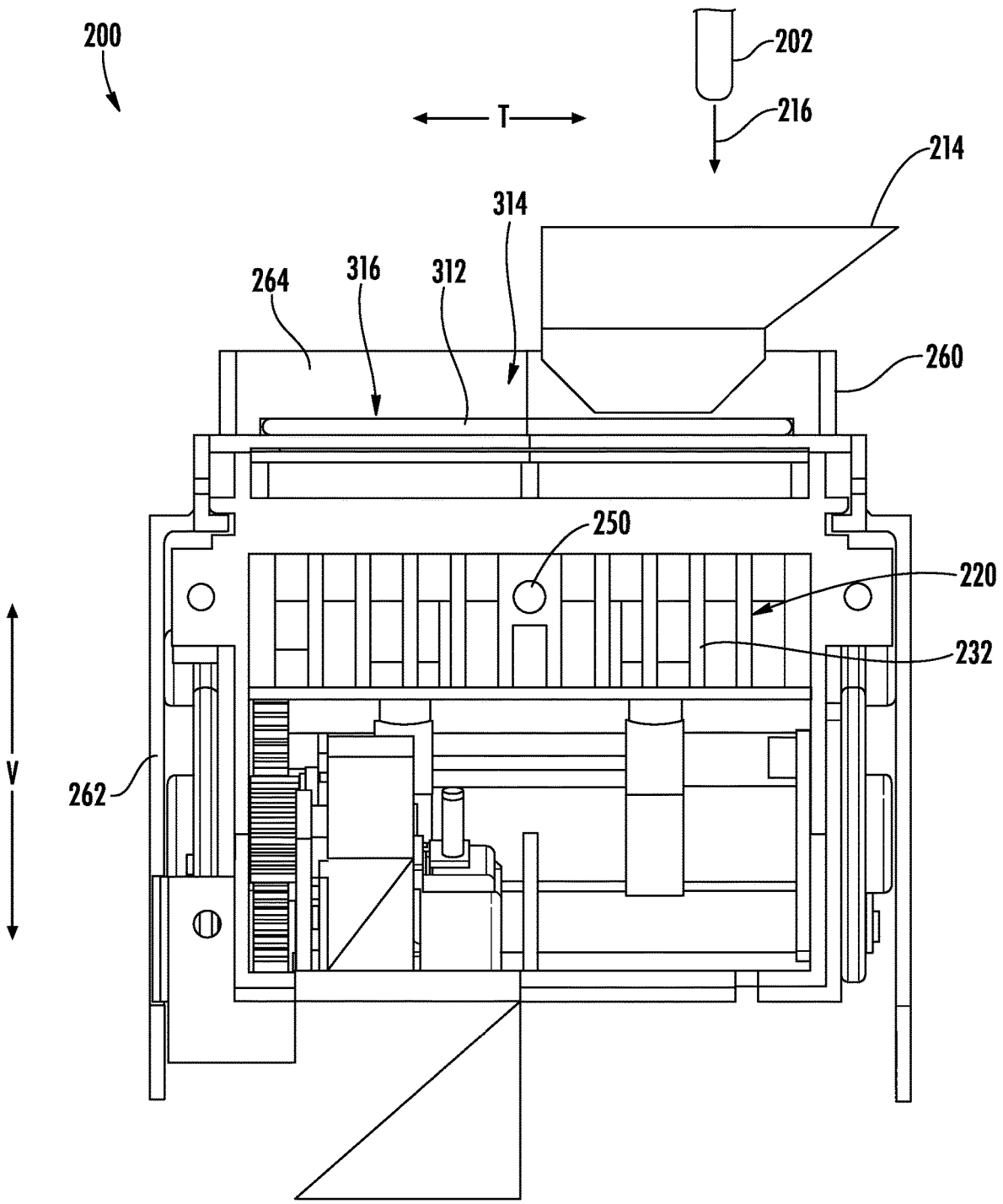
FIG. 7 provides a rear view of the exemplary ice making assembly of FIG. 3 according to an exemplary embodiment with a retention bracket removed for clarity.
Figure 8:
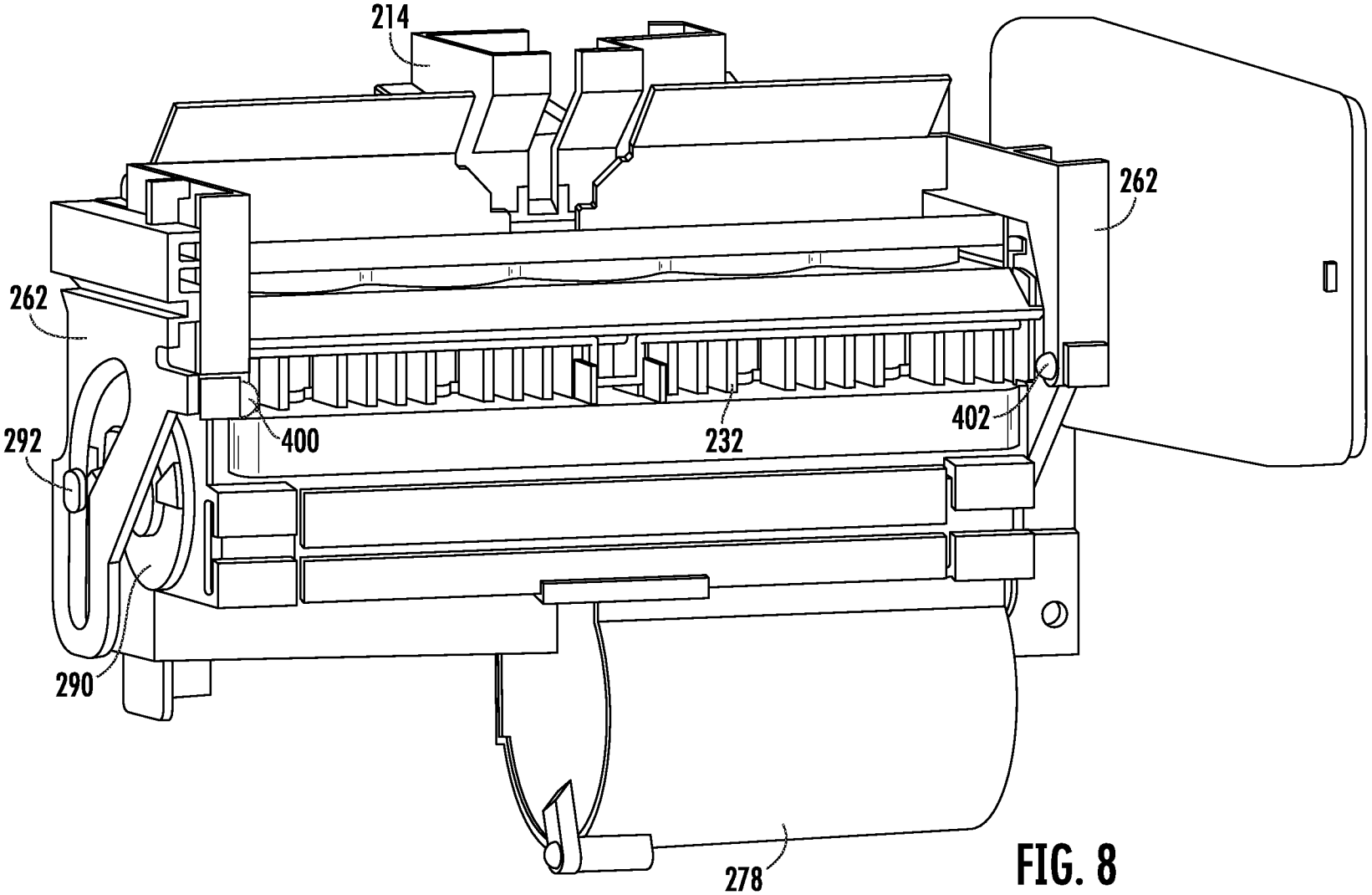
FIG. 8 provides a perspective view of the exemplary ice making assembly of FIG. 3 according to one or more exemplary embodiments of the present subject matter.

Referring now specifically to FIG. 7, heat exchanger 220 may further define a hole for receiving a temperature sensor 250 which is used to determine when ice cubes 204 have been formed such that an ejection process may be performed. In this regard, for example, temperature sensor 250 may be in operative communication with controller 164 which may monitor the temperature of heat exchanger 220 and the time water has been in mold cavities 212 to predict when ice cubes 204 have been fully frozen. As used herein, "temperature sensor" may refer to any suitable type of temperature sensor. For example, the temperature sensors may be thermocouples, thermistors, or resistance temperature detectors. In addition, although exemplary positioning of a single temperature sensor 250 is illustrated herein, it should be appreciated that ice making assembly 200 may include any other suitable number, type, and position of temperature sensors according to alternative embodiments.

Referring now specifically to FIGS. 4 through 7, ice making assembly 200 further includes a sweep assembly 260 which is positioned over resilient mold 210 and is generally configured for pushing ice cubes 204 out of mold cavities 212 and into storage bin 152 after they are formed. Specifically, according to the illustrated embodiment, sweep assembly 260 is movable along the horizontal direction (i.e., within a horizontal plane generally perpendicular to the vertical direction V, such as a lateral-transverse plane defined by the lateral direction L and the transverse direction T) between a retracted position (e.g., as shown in FIG. 5) and an extended position (e.g., as shown in FIG. 6). According to the illustrated embodiment, sweep assembly 260 and fill cup 214 may be integrally formed as a single piece, with fill cup 214 being positioned on top of sweep assembly 260. In this manner, sweep assembly 260 and fill cup 214 may move in unison along a horizontal direction, e.g., the lateral direction L or other direction generally perpendicular to the vertical direction V, during the ice discharge process.

As described in more detail below, sweep assembly 260 remains in the retracted position while water is added to resilient mold 210, e.g., through fill cup 214. Sweep assembly 260 also remains in the retracted position throughout the entire freezing process, and as lifter mechanism 240 is moved towards the raised position. After ice cubes 204 are in the raised position, sweep assembly 260 moves horizontally from the retracted position to the extended position, e.g., toward front end 230 of ice making assembly 200. In this manner, sweep assembly pushes ice cubes 204 off of lifter mechanism 240, out of resilient mold 210, and over a top of heat exchanger 220 where they may fall into storage bin 152.

Notably, dispensing ice cubes 204 from the top of ice making assembly 200 permits a taller storage bin 152, and thus a larger ice storage capacity relative to ice making machines that dispense ice from a bottom of the icemaker. According to the illustrated embodiment, water supply spout 202 is positioned above fill cup 214 (in the retracted position) such that the flow of water may be directed into resilient mold 210. In addition, water supply spout 202 is positioned such that sweep assembly 260 may move between the retracted position and the extended position without contacting water supply spout 202. According to alternative embodiments, water supply spout 202 may be coupled to mechanical actuator which lowers water supply spout 202 close to resilient mold 210 while sweep assembly 260 is in the retracted position. In this manner, the overall height or profile of ice making assembly 200 may be further reduced, thereby maximizing ice storage capacity and minimizing wasted space.

According to the illustrated embodiment, sweep assembly 260 generally includes vertically extending side arms 262 that are used to drive a raised frame 264 that is positioned over, e.g., above, resilient mold 210. Specifically, raised frame 264 extends around resilient mold 210 and thereby prevents or reduces splashing of water within resilient mold 210. This may be advantageous, such as when ice making assembly 200 is mounted on refrigerator door 128 because movement of refrigerator door 128 may cause sloshing of water within mold cavities 212.

In addition, as best shown in FIGS. 5 and 6, sweep assembly 260 may further define an angled pushing surface 268 proximate rear end 228 of ice making assembly 200. In general, angled pushing surface 268 is configured for engaging ice cubes 204 while they are pivoted upward and as sweep assembly 260 is moving toward the extended position to rotate ice cubes 204 over and out of ice making assembly 200. Specifically, angled pushing surface may extend at an angle 270 (FIG. 5) relative to the vertical direction V. According to the illustrated embodiment, angle 270 is less than about 10 degrees, though any other suitable angle for urging ice cubes to rotate 180 degrees may be used according to alternative embodiments.

Referring again generally to FIGS. 3 through 13, ice making assembly 200 may include a drive mechanism 276 which is operably coupled to both lifter mechanism 240 and sweep assembly 260 to selectively raise lifter mechanism 240 and slide sweep assembly 260 to discharge ice cubes 204 during operation. Specifically, according to the illustrated embodiment, drive mechanism 276 comprises a drive motor 278. As used herein, "motor" may refer to any suitable drive motor and/or transmission assembly for rotating a system component. For example, motor 278 may be a brushless DC electric motor, a stepper motor, or any other suitable type or configuration of motor. Alternatively, for example, motor 278 may be an AC motor, an induction motor, a permanent magnet synchronous motor, or any other suitable type of AC motor. In addition, motor 278 may include any suitable transmission assemblies, clutch mechanisms, or other components.

According to an exemplary embodiment, motor 278 may be mechanically coupled to a rotating cam 280. Lifter mechanism 240, or more specifically lifter arm 242, may ride against rotating cam 280 such that the profile of rotating cam 280 causes lifter mechanism 240 move between the lowered position and the raised position as motor 278 rotates rotating cam 280. In addition, according to an exemplary embodiment, lifter mechanism 240 may include a roller 282 mounted to the lower end of lifter arm 242 for providing a low friction interface between lifter mechanism 240 and rotating cam 280.

Ice making assembly 200 may include a plurality of lifter mechanisms 240, each of the lifter mechanisms 240 being positioned below one of the mold cavities 212 of the resilient mold 210 (and ice cubes 204 therein) or being configured to raise a separate portion of resilient mold 210. In such an embodiment, rotating cams 280 are mounted on a cam shaft 284 which is mechanically coupled with motor 278. As motor 278 rotates cam shaft 284, rotating cams 280 may simultaneously move lifter arms 242 along the vertical direction V. In this manner, each of the plurality of rotating cams 280 may be configured for driving a respective one lifter mechanism 240. In addition, a roller axle (not shown) may extend between rollers 282 of adjacent lifter mechanisms 240 to maintain a proper distance between adjacent rollers 282 and to keep them engaged on top of rotating cams 280.

Referring still generally to FIGS. 3 through 13, drive mechanism 276 may further include a yoke wheel 290 which is mechanically coupled to motor 278 for driving sweep assembly 260. Specifically, yoke wheel 290 may rotate along with cam shaft 284 and may include a drive pin 292 positioned at a radially outer portion of yoke wheel 290 and extending substantially parallel to an axis of rotation of motor 278. In addition, side arms 262 of sweep assembly 260 may define a drive slot 294 which is configured to receive drive pin 292 during operation. Although a single yoke wheel 290 is described and illustrated herein, it should be appreciated that both side arms 262 may include yoke wheel 290 and drive slot 294 mechanisms.

Notably, the geometry of each drive slot 294 is defined such that drive pin 292 moves sweep assembly 260 along the horizontal direction when drive pin 292 reaches an end 296 of drive slot 294. Notably, according to an exemplary embodiment, this occurs when lifter mechanism 240 is in the raised position. In order to provide controller 164 with knowledge of the position of yoke wheel 290 (and drive mechanism 276 more generally), ice making assembly 200 may include a position sensor (not shown) for determining a zero position of yoke wheel 290.

According to an exemplary embodiment, the position sensor includes a magnet (not shown) positioned on yoke wheel 290 and a Hall-effect sensor (not shown) mounted at a fixed position on ice making assembly 200. As yoke wheel 290 is rotated toward a predetermined position, the Hall-effect sensor can detect the proximity of the magnet and controller 164 may determine that yoke wheel 290 is in the zero position (or some other known position). Alternatively, any other suitable sensors or methods of detecting the position of yoke wheel 290 or drive mechanism 276 may be used. For example, motion sensors, camera systems, optical sensors, acoustic sensors, or simple mechanical contact switches may be used according to alternative embodiments.

According to an exemplary embodiment the present subject matter, motor 278 may begin to rotate after ice cubes 204 are completely frozen and ready for harvest. In this regard, motor 278 rotates rotating cam 280 (and/or cam shaft 284) approximately 90 degrees to move lifter mechanism 240 from the lowered position to the raised position. In this manner, lifter projection 246 pushes resilient mold 210 upward, thereby deforming resilient mold 210 and releasing ice cubes 204. Ice cubes 204 continue to be pushed upward until they pass into storage bin 152.

Notably, yoke wheel 290 rotates with cam shaft 284 such that drive pin 292 rotates within drive slot 294 without moving sweep assembly 260 until yoke wheel 290 reaches the ninety-degree position. Thus, as motor 278 rotates past ninety degrees (90°), lifter mechanism 240 remains in the raised position while sweep assembly 260 moves towards the extended position. In this manner, angled pushing surface 268 engages the raised end of ice cubes 204 to push them out of resilient mold 210 and rotates ice cubes 204 approximately one hundred and eighty degrees (180°) before dropping them into storage bin 152.

When motor 278 reaches one hundred and eighty degrees (180°) rotation, sweep assembly 260 is in the fully extended position and ice cubes 204 will fall into storage bin 152 under the force of gravity. As motor 278 rotates past one hundred and eighty degrees (180°), drive pin 292 begins to pull sweep assembly 260 back toward the retracted position, e.g., via engagement with drive slot 294. Simultaneously, the profile of rotating cam 280 is configured to begin lowering lifter mechanism 240. When motor 278 is rotated back to the zero position, as indicated for example by a position sensor, sweep assembly 260 may be fully retracted, lifter mechanism 240 may be fully lowered, and resilient mold 210 may be ready for a supply fresh water. At this time, water supply spout 202 may provide a flow of fresh water into mold cavities 212 and the process may be repeated.

Notably, due to the proximity of fill cup 214 to cold air and temperatures necessary for forming ice cubes 204, water 216 dispensed from water supply spout 202 may have a tendency to freeze in locations where ice is not desirable. When such undesirable freezing occurs, the operation and performance of ice making assembly 200 may be negatively affected. For example, water fill volumes may be affected, resulting in ice cubes that are smaller or larger than desired. In addition, ice in the wrong places may cause water spills or may jam the discharge mechanisms of ice making assembly 200. Thus, some exemplary embodiments of the ice making assembly 200 may include features for eliminating the buildup of ice in undesirable locations. These undesirable ice formations may be referred to herein as ice clogs and are identified generally in the figures by reference numeral 310 (see, FIGS. 4-6,).

Specifically, ice making assembly 200 may include one or more heating elements 312 that are in thermal communication with fill cup 214 for selectively heating fill cup 214. As used herein, the term "heating element" and the like are generally intended to refer to any suitable electrically-driven heat generator. For instance, the heating element 312 may be an electric heater in conductive thermal engagement with fill cup 214 and may include one or more resistive heating elements. For example, positive thermal coefficient of resistance heaters (PTCR) that increase in resistance upon heating may be used, such as metal, ceramic, or polymeric PTC elements (e.g., such as electrical resistance heating rods or calrod heaters). In addition, heating elements 312 may be coated in silicone, embedded within fill cup 214, or positioned in any other suitable manner.

Heating element 312 may generally be mounted in any manner suitable for breaking up ice clogs 310 or melting undesirable ice buildup. In this regard, according to the exemplary embodiment, heating element 312 may be positioned adjacent discharge spout 218 of fill cup 214. In this regard, a common clogging location is at the point where discharge spout 218 directs the flow of water 216 into mold cavity to 12. Notably, the ice clog 310 at this location may prevent proper discharge or ejection of ice cubes 204 from mold cavities 212. In this regard, as lifter mechanism 240 pushes ice cube 204 up and out of resilient mold 210, a back end of ice cube 204 may contact ice clog 310 causing it to tilt forward. As sweep assembly 260 moves forward to initiate the ejection process, ice cube 204 can get jammed between sweep assembly 260 and a front of resilient mold 210.

To prevent such issues, heating element 312 may be selectively energized when such an ice clog 310 is detected to locally melt and break up the ice clog 310. Specifically, according to the illustrated embodiment, heating element 312 is positioned on a back side 314 of fill cup 214 immediately opposite discharge spout 218. In this regard, fill cup 214 may define a groove 316 that it is sized for receiving heating element 312. Groove 316 may be defined such that the thickness of fill cup 214 adjacent groove 316 is less than a nominal thickness of sweep assembly 260 and fill cup 214. Thus, heating element 312 is positioned as close as possible to ice clog 310 without comprising the structural integrity of fill cup 214.

In addition, ice making assembly 200 may include a retention bracket 320 that snaps onto fill cup 214 or sweep assembly 260 to secure heating element 312 in position. In this manner, retention bracket 320 may be a flat piece of plastic that is positioned firmly against heating element 312 opposite of fill cup 214. In this manner, heating element 312 may be in firm contact with fill cup 214 within groove 316 for improved thermal conductivity. As shown, retention bracket 320 may include clips 322 that are received within a notch defined on a front end of sweep arm 260 to secure retention bracket 320 in place. It should be appreciated that other configurations of retention bracket 320 and other means for securing heating element 312 may be used while remaining within the scope of the present subject matter.

Notably, localized heating at discharge spout 218 may prevent ice clogs 310 at discharge spout 218, but may be ineffective at melting ice clogs 310 positioned elsewhere within ice making assembly 200. Thus, according to alternative embodiments, ice making assembly 200 may further include a secondary harvest heater in thermal communication with heat exchanger 220. Such secondary harvest heater may be used independently of or in conjunction with heating element 312 to clear ice clogs 310 throughout ice making assembly 200.

As may be seen, e.g., FIGS. 8-13, the ice making assembly 200 may further include an infrared light (IR) emitter 400 and an IR receiver 402, e.g., whereby an IR beam 406 is defined therebetween. It is understood that the IR emitter 400 and IR receiver 402 are omitted from FIGS. 1-7 solely for the sake of simplicity and clarity, e.g., to more clearly depict and label other elements of the ice making assembly 200. Thus, it is understood that the exemplary configurations depicted in FIGS. 1-7 are in no way intended to exclude the presence of the IR emitter 400 and IR receiver 402 therefrom.

The IR emitter 400 and IR receiver 402 may be collectively referred to as an IR assembly. In some embodiments, the IR assembly may be mounted on a movable part of the ice making assembly 200, such as on the sweep assembly 260, e.g., on the side arms 262 thereof. For example, the infrared emitter 400 may be mounted to a first side arm 262 of the sweep assembly 260 and the infrared detector 402 may be mounted to a second side arm 262 of the sweep assembly 260. In the exemplary illustrated embodiments, the IR beam 406 travels from right to left on the page, e.g., in FIGS. 9 through 11. It should be understood that this arrangement is by way of example only and other configurations are also possible within the scope of the present disclosure, such as the positions of the IR emitter 400 and the IR detector 402 may be reversed.

In some embodiments, infrared emitter 400 and the infrared detector 402 may be positioned to mutually face each other, and may be aligned whereby the infrared beam 406 from the infrared emitter 400 passes through a storage volume defined within the ice storage bin 152 and to the infrared detector 402. The IR assembly, in particular the IR detector 402 thereof, may be communicatively coupled with the controller 164, e.g., whereby an interruption of the IR beam 406 may be detected, such as by or in response to a signal from the IR detector 402 when the IR beam 406 is not detected. For example, the IR beam 406 may not be detected when the flight path of the IR beam 406 is broken or interrupted by an object, such as an ice cube or ice piece, between the IR emitter 400 and the IR detector 402. Accordingly, when the accumulated pile of ice cubes within the ice storage bin 154 reaches the level, e.g., along the vertical direction V, of the IR emitter 400 and the IR detector 402, as well as the IR beam 406 therebetween, the IR beam 406 may be broken and such break may be detected by the IR detector 402. Thus, a fill level of ice in the internal storage volume of the ice storage bin 152 may be detected by the IR assembly. For example, when the ice pile, or any one or more ice cubes therein, reaches the IR assembly, the ice storage bin 152 may be full, and the controller 164 may be configured to pause operation of the ice making assembly 200 when the ice storage bin 154 is already full. The portion of the ice pile, e.g., the one or more ice cubes therein, which first reaches the level of the IR assembly may be the apex or highest portion of the ice pile, or may be generally the highest portion of the ice pile, such that the full ice storage bin 152 may be detected early, such as to reduce or prevent overfilling the ice storage bin 152, which may occur when the apex of the accumulated ice cubes is not detected by the IR assembly, e.g., because the apex is outside of a line or area covered by the IR beam 406.

In some embodiments, the controller 164 may check whether the IR beam 406 is broken before filling the mold body 210 with liquid water, e.g., while the sweep assembly 260 is in the home position in embodiments where the IR assembly is mounted to the sweep assembly 260. In some embodiments, the controller 164 may be configured to check whether the IR beam 406 is broken during or after ice harvesting, such as while the sweep assembly 260 retracts, e.g., returns to the home position from the extended position, e.g., in embodiments where the IR assembly is mounted to the sweep assembly 260.

Figure 10:
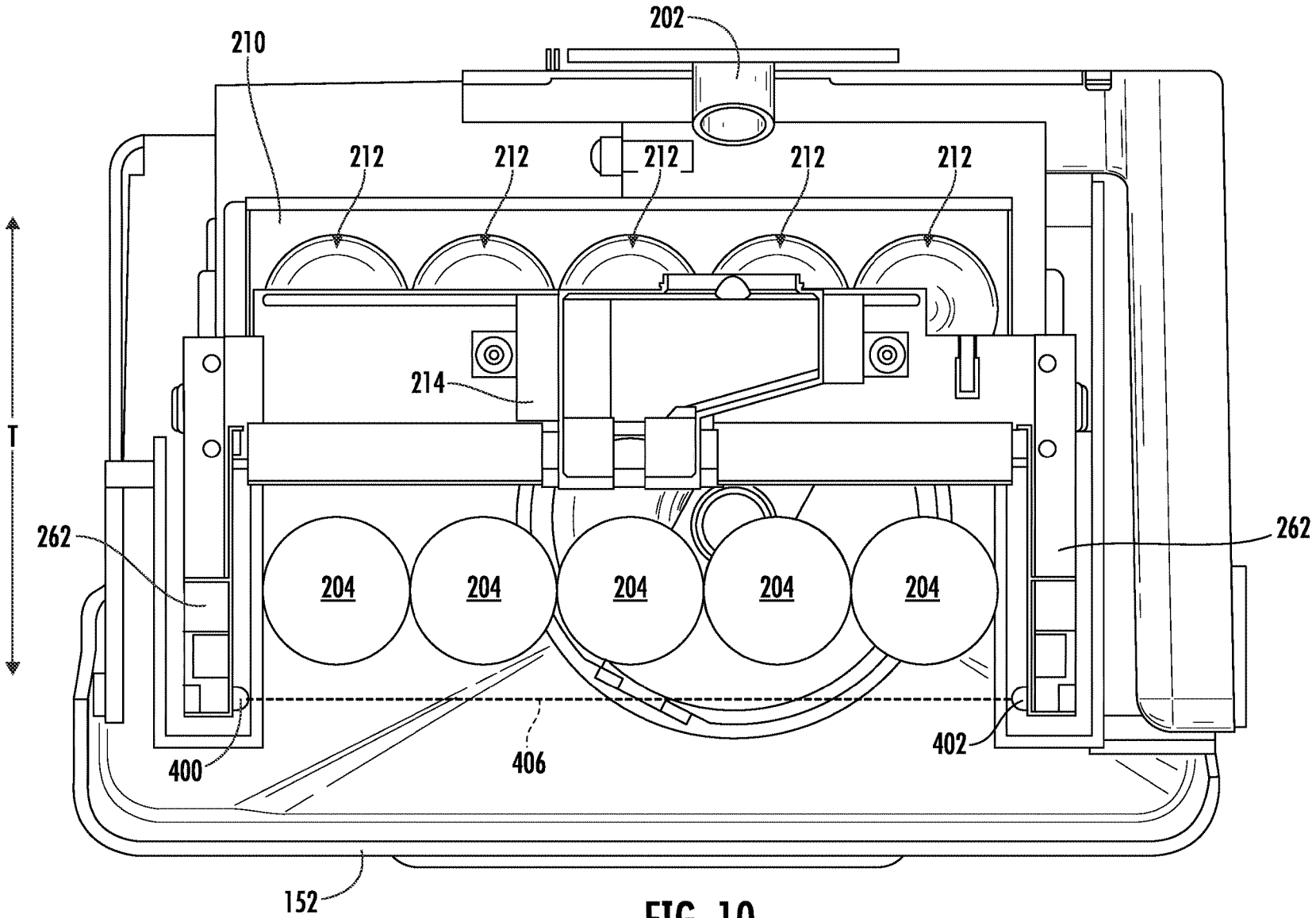
FIG. 10 provides a top-down view of the exemplary ice making assembly of FIG. 8 with the sweep assembly thereof in an extended position.
Figure 11:
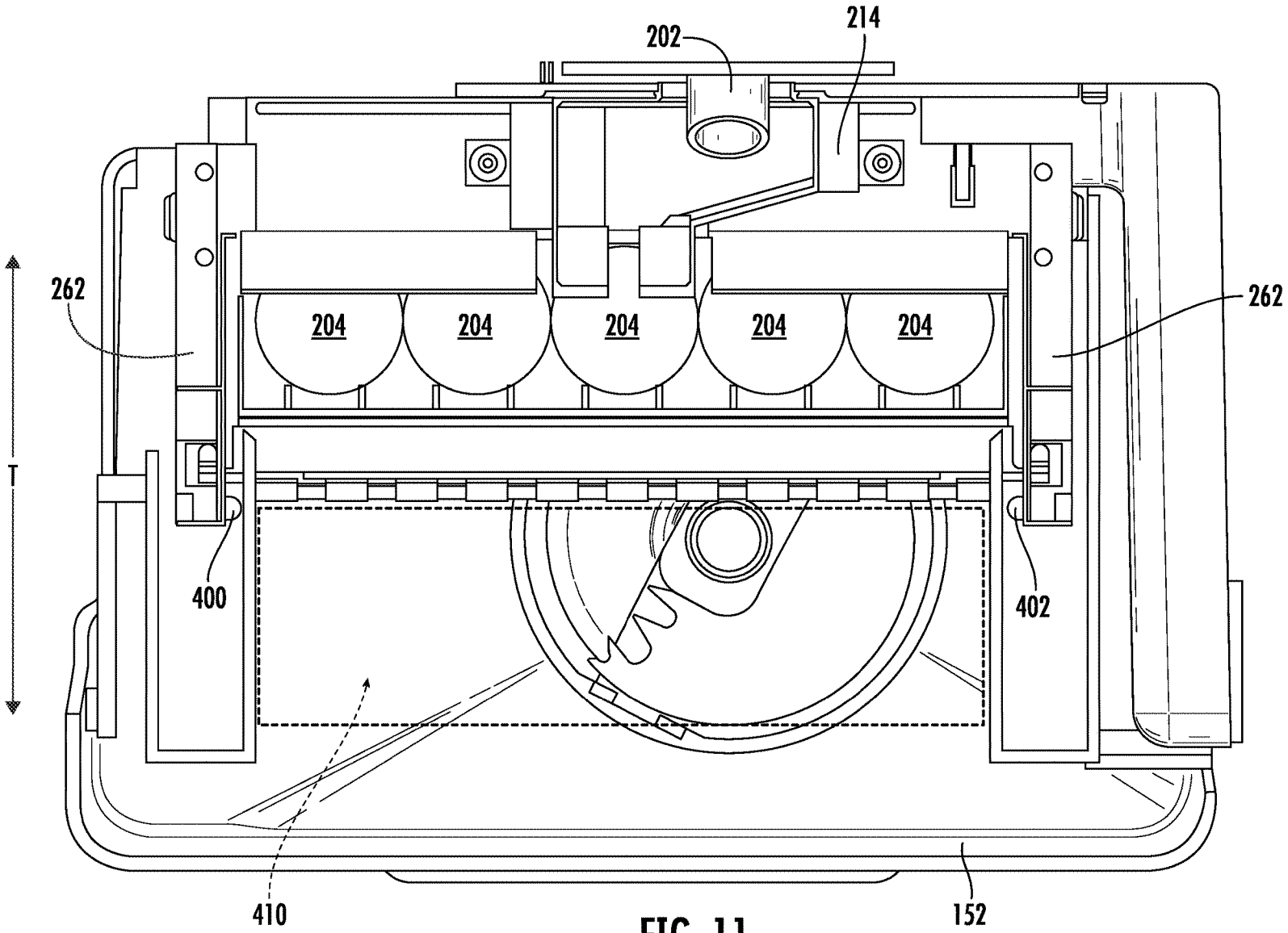
FIG. 11 provides a top-down view of the exemplary ice making assembly of FIG. 8 with an ice detection area schematically illustrated.

The fill level of the ice cubes in the ice storage bin 152 may be detected by the IR assembly whenever an ice cube, which may be the highest or apex of the ice pile within the ice storage bin 152, reaches the level of the IR assembly at any point along the line of the IR beam 406. When the IR beam 406 is stationary, the fill level, e.g., the ice storage bin 152 being full, may be detected along the single line defined by the IR beam 406. In embodiments where the IR beam 406 is mounted to a movable part of the ice making assembly, the full ice storage bin 152 may be detected whenever an ice cube reaches any point within an ice detection area, such as the ice detection area 410 illustrated in FIG. 11. For example, in embodiments where the IR emitter 400 and the IR detector 402 are mounted to the sweep arms 262, e.g., as illustrated in FIG. 11, the IR beam 406 (see, e.g., FIGS. 9 and 10) may sweep through the ice detection area 410 as the sweep assembly 260 travels between the home position (FIG. 9) and the extended position (FIG. 10), e.g., where a rearward limit of the ice detection area 410 is defined by the location of the IR beam 406 when in the home position and a forward limit of the ice detection area 410 is defined by the location of the IR beam 406 when in the extended position, and the IR beam 406 moves continuously through each intermediate position therebetween as the sweep assembly 260 moves from the home position to the extended position and/or retracts from the extended position to the home position, whereby the IR beam 406 covers, e.g., sweeps through, the entire ice detection area 410 in such embodiments.

In some embodiments, the sweep assembly 260 may be movable between the home position and the extended position along a direction generally perpendicular to the vertical direction V, and/or within a plane generally perpendicular to the vertical direction V, such that, in embodiments where the IR assembly is mounted to the sweep assembly 260, the IR assembly moves with the sweep assembly 260 along the direction generally perpendicular to the vertical direction V and/or within the plane generally perpendicular to the vertical direction V. In the particular context of the sweep assembly 260 movement, "generally perpendicular to the vertical direction V" includes angles within plus or minus 15° of perpendicular, such as an angle between 75° and 90° to the vertical direction V. For example, as may be seen in FIGS. 12 and 13, the IR beam 406 may extend through a slot 412, such as two slots 412, one on each side of the ice storage bin 152. Although only one is visible in FIGS. 12 and 13, the other slot 412 may be a mirror image of the illustrated slot 412. The slots 412 may be oriented to follow the path of the IR beam as the IR assembly moves, e.g., along with the sweep assembly 260 to which the IR assembly may be mounted, between the home position and the extended position. For example, the slots 412 may be generally linear, e.g., may have a generally constant (e.g., varying by ten percent or less) vertical dimension across the entire length of each slot 412, and may be oriented at the same angle with respect to the vertical direction V as the direction of travel of the sweep assembly 260. In additional embodiments, the slots 412 may be triangular or may taper, such as the slots 412 may have a varying width to permit the IR beam 406 to travel therethrough without being obstructed at any point along the path of travel between the home position and the extended position. For example, in such embodiments, one edge of each slot 412, e.g., an upper edge or lower edge, may be generally perpendicular to the vertical direction V (in this instance, "generally" is used in the usual sense, e.g., within plus or minus ten degrees of perpendicular to the vertical direction V), and the other edge of each slot 412, e.g., the other of the upper edge and the lower edge, may be oblique to the vertical direction V, such as at an angle between about fifteen degrees and about thirty-five degrees with respect to the vertical direction V.

Figure 12:
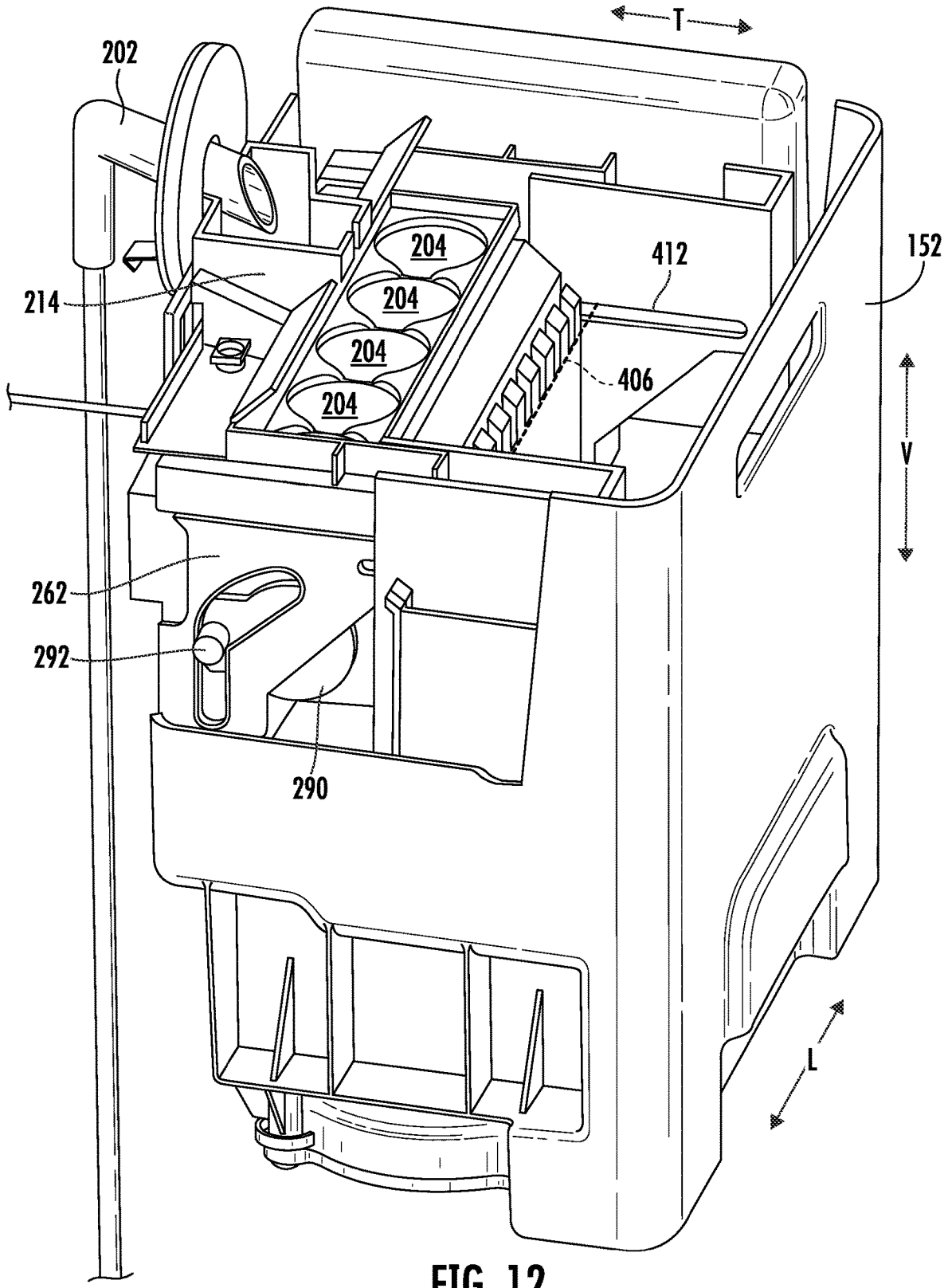
FIG. 12 provides another perspective view of the exemplary ice making assembly of FIG. 8 with the sweep assembly thereof in the home position.
Figure 13:
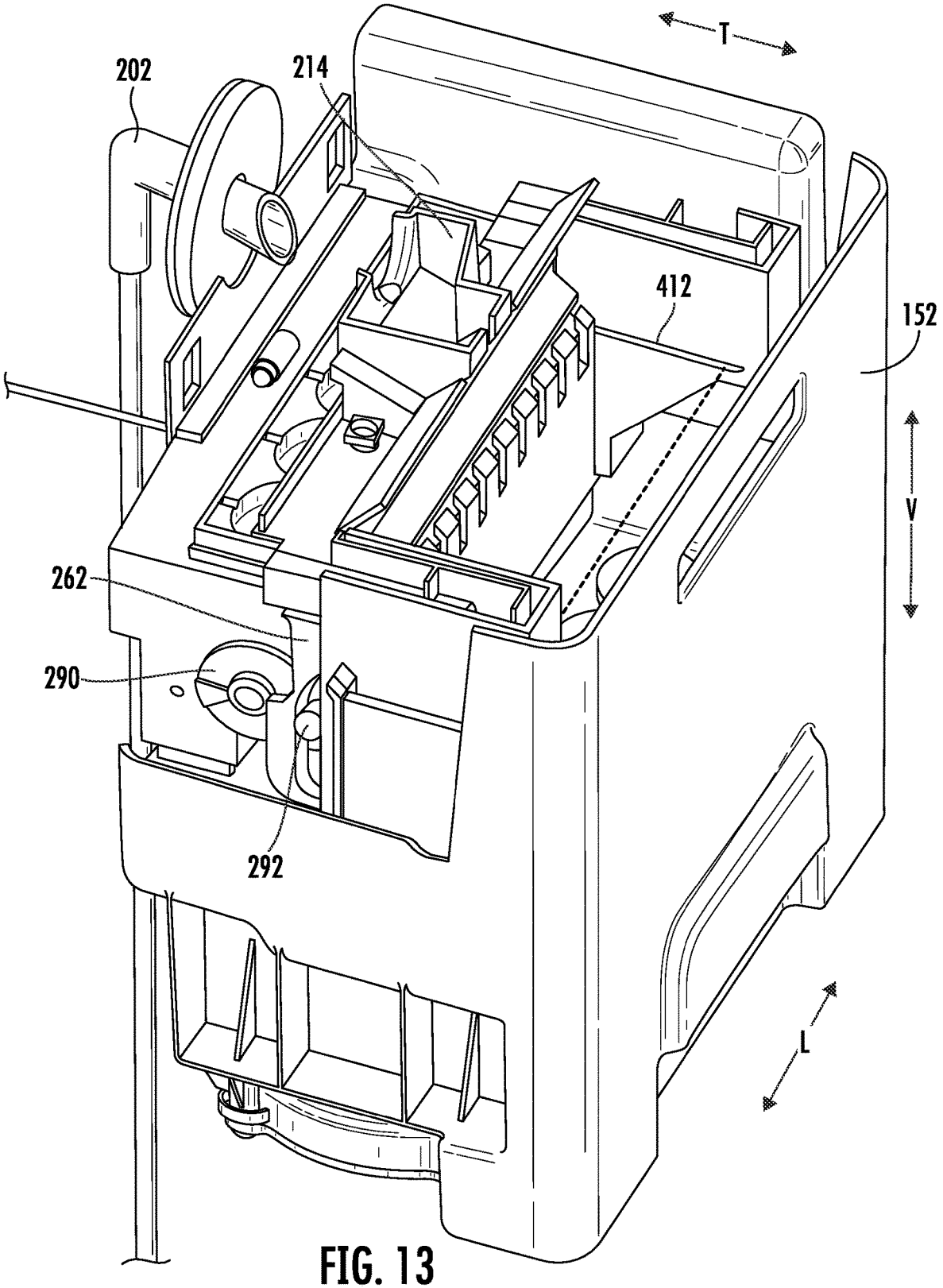
FIG. 13 provides another perspective view of the exemplary ice making assembly of FIG. 8 with the sweep assembly thereof in the extended position.

Also as may be seen, e.g., in FIGS. 12 and 13 (it being understood that the illustrated slot 412 in FIGS. 12 and 13 coincides vertically with the IR emitter 400 and IR detector 402), the infrared emitter 400 and the infrared detector 402 may, in some embodiments, be positioned within a top portion of the ice making assembly 200, such as within twenty-five percent or less of the overall vertical dimension of the ice storage bin 152 from the uppermost point of the ice storage bin 152, such as spaced apart from the uppermost point of the ice storage bin 152 by about ten percent or less of the overall vertical dimension of the ice storage bin 152.

As mentioned above, the ice making assembly 200 may be configured for forming one or more ice cubes therein, e.g., may be configured to receive liquid water in one or more mold cavities 212 defined in the mold body 210 and reduce a temperature of the liquid water in the one or more mold cavities 212 to thereby form one or more ice cubes 204. In some embodiments, e.g., as best seen in FIG. 10, the infrared emitter 400 and the infrared detector 402 may be positioned forward of a point at which the one or more ice cubes 204 are ejected from the ice making assembly 200 when the one or more ice cubes 204 is or are harvested. In embodiments where the IR emitter 400 and the IR detector 402 are so positioned, the IR assembly may thereby detect that the ice storage bin 152 is full when the sweep assembly 260 retracts, e.g., moves from the extended position to the home position, after harvesting the one or more ice cubes 204. Thus, for example, in such embodiments, the IR assembly may detect that the ice storage bin 152 is full after harvesting the ice cubes 204, e.g., immediately after harvesting. At least one of the one or more ice cubes 204 which were harvested immediately before detecting the full ice storage bin 152 may be the highest in the pile in the ice storage bin 152, e.g., at least one of the one or more ice cubes 204 which were harvested immediately before detecting the full ice storage bin 152 may be the ice cube(s) 204 that reached the level of the IR assembly. In such embodiments, the controller 164 may pause operation of the ice making assembly in response to detecting the full ice storage bin 152 after harvesting, e.g., the controller 164 may be configured to pause a fill operation such that liquid water is not directed into the mold body 210 after, e.g., immediately after, harvesting the ice cubes 204 when the harvested ice cubes 204 cause the ice storage bin 152 to become full.

Figure 9:
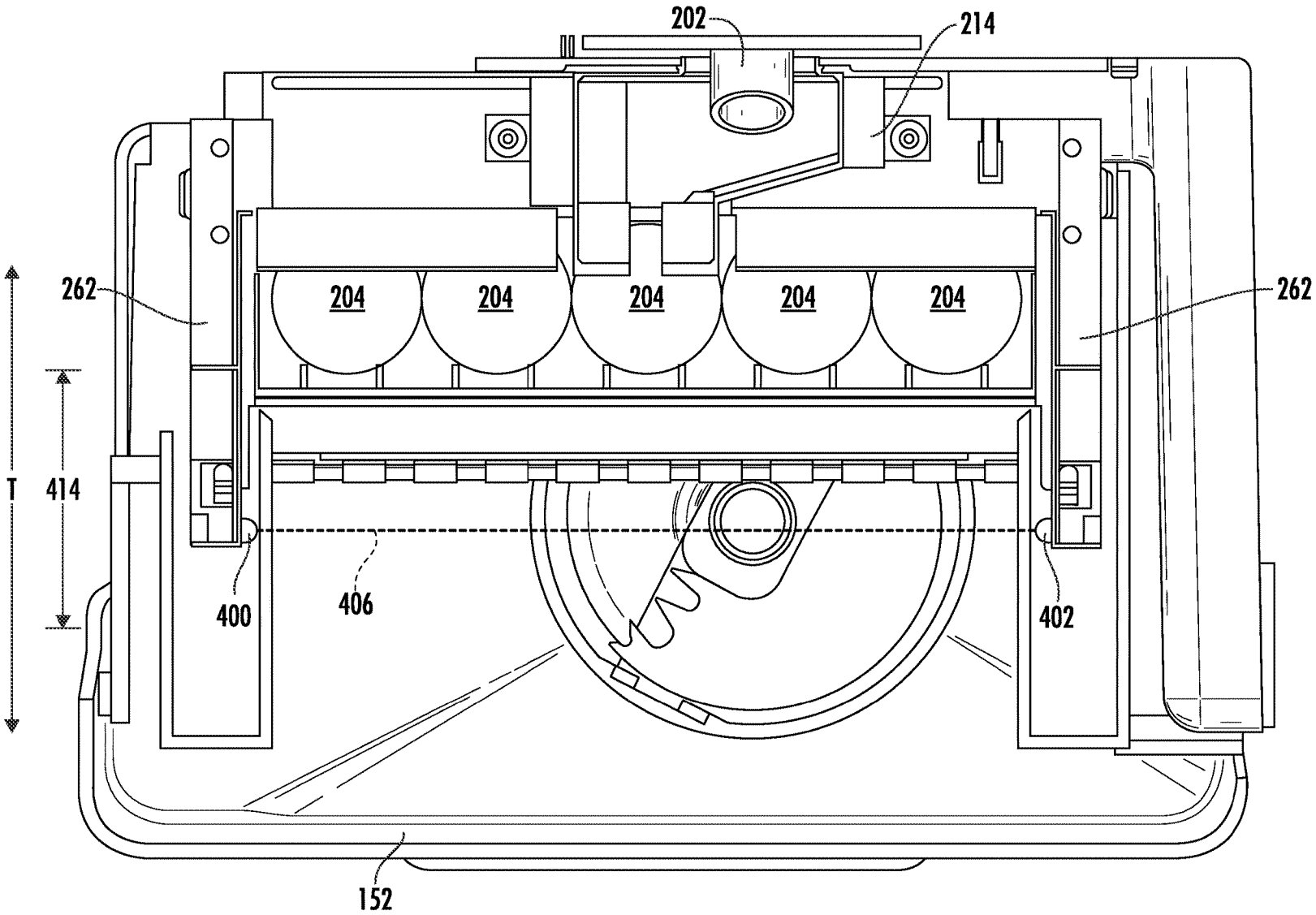
FIG. 9 provides a top-down view of the exemplary ice making assembly of FIG. 8 with a sweep assembly thereof in a home position.

A center portion 414 of the ice making assembly 200 and/or of the ice storage bin 152 thereof is noted, e.g., in FIG. 9. In some embodiments, the infrared emitter 400 and the infrared detector 402 may be positioned above (such as directly above along the vertical direction V) the center portion 414 of the ice storage bin 152, e.g., when mounted to a stationary part of the ice making assembly 200, or when in a home position in embodiments where the IR emitter 400 and the IR detector 402 are mounted to a moving part of the ice making assembly 200. For example, the center portion 414 may correspond to a middle third of the ice storage bin 152, e.g., along the transverse direction T. In some embodiments, the infrared emitter 400 and the infrared detector 402 may be positioned directly above the exact center of the ice storage bin 152 along the vertical direction V, or may be positioned generally above the exact center of the ice storage bin 152 along the vertical direction V, where "generally above" includes offset, e.g., along the transverse direction T such as forward or rearward, by ten percent or less of a transverse dimension (e.g., depth) of the ice storage bin 152. For example, the apex of the accumulated ice cubes 204 within the ice storage bin 152 may occur at or about the center portion 414 of the ice storage bin 152 in most instances. Thus, positioning the IR emitter 400 and the IR detector 402 above the center portion 414 as described may advantageously detect a full ice storage bin 152 at the highest point reached by the accumulated ice, e.g., may avoid or reduce the likelihood of overfilling the ice storage bin 152 when the apex is not detected, e.g., when the apex occurs at a location not covered by the IR assembly.

It is noted that although these exemplary embodiments are explicitly illustrated, one of ordinary skill in the art would understand that additional or alternative embodiments or configurations may be provided to include one or more features of these examples. For example, the type, position, and configuration of heating element 312 and secondary harvest heater 330 may vary while remaining within scope of the present subject matter. In addition, variations and modifications may be made to sweep arm 260, fill cup 214, and other features of ice making assembly 200.

Although a specific configuration and operation of ice making assembly 200 is described above, it should be appreciated that this is provided only for the purpose of explaining aspects of the present subject matter. Modifications and variations may be applied, other configurations may be used, and the resulting configurations may remain within the scope of the invention. For example, resilient mold 210 may define any suitable number of mold cavities 212, drive mechanism 276 may have a different configuration, or lifter mechanism 240 and sweep assembly 260 may have dedicated drive mechanisms. Furthermore, other control methods may be used to form and harvest ice cubes 204. One skilled in the art will appreciate that such modifications and variations may remain within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, comprising:
   - a cabinet;
   - a door rotatably mounted to the cabinet;
   - an ice making chamber defined in one of the cabinet and the door;
   - an ice making assembly positioned within the ice making chamber;
   - an ice storage bin positioned within the ice making chamber;
   - an infrared emitter mounted to a movable sweep assembly of the ice making assembly; and
   - an infrared detector mounted to the movable sweep assembly of the ice making assembly.

2. The refrigerator appliance of claim 1, wherein the infrared emitter and the infrared detector are aligned whereby an infrared beam from the infrared emitter passes through a storage volume defined within the ice storage bin and to the infrared detector.

3. The refrigerator appliance of claim 1, wherein the infrared emitter is mounted to a first side arm of the sweep assembly and wherein the infrared detector is mounted to a second side arm of the sweep assembly.

4. The refrigerator appliance of claim 1, wherein the sweep assembly is movable between a home position and an extended position, wherein the infrared emitter and the infrared detector are aligned whereby an infrared beam from the infrared emitter extends to the infrared detector, and whereby the infrared beam sweeps an area when the sweep assembly moves between the home position and the extended position.

5. The refrigerator appliance of claim 4, wherein the sweep assembly is movable between the home position and the extended position along a direction generally perpendicular to the vertical direction.

6. The refrigerator appliance of claim 1, wherein the infrared emitter and the infrared detector are positioned within a top portion of the ice making assembly, wherein the top portion of the ice making assembly comprises twenty-five percent of the overall vertical dimension of the ice storage bin from an uppermost point of the ice storage bin.

7. The refrigerator appliance of claim 1, wherein the ice making assembly comprises a mold defining a mold cavity, the mold configured to receive liquid water therein and thereby form an ice cube, wherein the infrared emitter and the infrared detector are positioned forward of a point at which the ice cube is ejected from the ice making assembly when the ice cube is harvested.

8. The refrigerator appliance of claim 1, wherein the infrared emitter and the infrared detector are positioned above a center portion of the ice storage bin.

9. A refrigerator appliance defining a vertical direction, a lateral direction, and a transverse direction, comprising:

a cabinet;

a door rotatably mounted to the cabinet;

an ice making chamber defined in one of the cabinet and the door;

an ice making assembly positioned within the ice making chamber;

an ice storage bin positioned within the ice making chamber;

an infrared emitter mounted to a sweep assembly of the ice making assembly; and an infrared detector mounted to the sweep assembly of the ice making assembly, wherein the infrared emitter and the infrared detector are positioned above a center portion of the ice storage bin when the infrared emitter and the infrared detector are in a home position.

10. The refrigerator appliance of claim 9, wherein the infrared emitter and the infrared detector are positioned within a top portion of the ice making assembly when in the home position, wherein the top portion of the ice making assembly comprises twenty-five percent of the overall vertical dimension of the ice storage bin from an uppermost point of the ice storage bin.

11. The refrigerator appliance of claim 9, wherein the infrared emitter and the infrared detector are aligned whereby an infrared beam from the infrared emitter passes through a storage volume defined within the ice storage bin and to the infrared detector.

12. The refrigerator appliance of claim 9, wherein the infrared emitter is mounted to a first side arm of the sweep assembly and wherein the infrared detector is mounted to a second side arm of the sweep assembly.

13. The refrigerator appliance of claim 9, wherein the sweep assembly is movable between the home position and an extended position, wherein the infrared emitter and the infrared detector are aligned whereby an infrared beam from the infrared emitter extends to the infrared detector, and whereby the infrared beam sweeps an area when the sweep assembly moves between the home position and the extended position.

14. The refrigerator appliance of claim 13, wherein the sweep assembly is movable between the home position and the extended position along a direction generally perpendicular to the vertical direction.

15. The refrigerator appliance of claim 9, wherein the ice making assembly comprises a mold defining a mold cavity, the mold configured to receive liquid therein and thereby form an ice cube, wherein the infrared emitter and the infrared detector are positioned forward of a point at which the ice cube is ejected from the ice making assembly when the ice cube is harvested.

* * * * *